US009874038B2

(12) United States Patent
Pashandi

(10) Patent No.: US 9,874,038 B2
(45) Date of Patent: Jan. 23, 2018

(54) COLLAPSIBLE SUN SHADE

(71) Applicant: Jalal Pashandi, Los Angeles, CA (US)

(72) Inventor: Jalal Pashandi, Los Angeles, CA (US)

( * ) Notice: Subject to any disclaimer, the term of this patent is extended or adjusted under 35 U.S.C. 154(b) by 0 days.

(21) Appl. No.: 15/233,550

(22) Filed: Aug. 10, 2016

(65) Prior Publication Data

US 2017/0044792 A1 Feb. 16, 2017

Related U.S. Application Data

(60) Provisional application No. 62/203,228, filed on Aug. 10, 2015.

(51) Int. Cl.
*E04H 15/58* (2006.01)
*E04H 15/48* (2006.01)
*E04H 15/44* (2006.01)

(52) U.S. Cl.
CPC ..... *E04H 15/58* (2013.01); *E04H 15/44* (2013.01); *E04H 15/48* (2013.01)

(58) Field of Classification Search
CPC ..... A45B 23/00; A45B 2023/0093; A45B 2023/0012; E04H 15/003; E04H 25/58; E04H 15/48; E04H 15/34
USPC ..... 135/120.3, 19.5, 34
See application file for complete search history.

(56) References Cited

U.S. PATENT DOCUMENTS 1,018,522 A 2/1912 Savage
1,493,915 A * 5/1924 Baker ..... E04H 15/003 135/146
2,554,204 A 5/1951 Mueller
2,764,993 A 10/1956 Wallace et al.
2,828,758 A 4/1958 Moro
2,888,021 A 5/1959 Adams
3,177,883 A * 4/1965 Militano ..... A45B 25/02 135/15.1
3,429,320 A 2/1969 Edelkind
3,651,847 A 3/1972 Casamassima
3,818,919 A 6/1974 Schultes et al.
4,063,318 A 12/1977 Nicholson
4,082,102 A 4/1978 Heuer
4,093,305 A 6/1978 Staroste et al.
4,100,633 A 7/1978 Pintos
4,132,236 A 1/1979 Petersen et al.
4,222,680 A 9/1980 Browning
4,312,371 A 1/1982 Koon
4,350,175 A 9/1982 DeMarco
4,379,349 A 4/1983 Larson
4,425,675 A 1/1984 Victor
(Continued)

*Primary Examiner* — Noah Chandler Hawk
(74) *Attorney, Agent, or Firm* — Edwin Tarver

(57) ABSTRACT

An automatically opening sunshade for shading a person includes a flexible connector made of a resilient deformable material. A central hub has a post anchor, a first arm anchor and a second arm anchor extending therefrom, with a post cut-out between the post anchor and the central hub, a first arm cut-out and a second arm cut-out between the first arm and the central hub, and the second arm and the central hub, respectively. A post extends from the post anchor, a first arm extends from the first arm anchor and a second arm extends from the second arm anchor, with a shade panel held by the first arm and the second arm. The flexible connector is molded such that the first arm, second arm, and shade panel, are held substantially horizontal under their own weight and the post is substantially vertical.

11 Claims, 6 Drawing Sheets

(56) References Cited

U.S. PATENT DOCUMENTS 4,624,275 A * 11/1986 Baldwin ..... A45B 19/00 135/15.1
4,639,958 A 2/1987 Lerner
4,641,883 A 2/1987 Kato
4,766,919 A 8/1988 Crates
4,836,232 A 6/1989 De Rosa et al.
4,971,090 A 11/1990 Uhl
5,090,435 A * 2/1992 Leclercq ..... A45B 23/00 135/116
5,102,190 A 4/1992 Akin et al.
5,116,258 A 5/1992 Vennik
5,116,288 A 5/1992 Kondo et al.
5,143,108 A 9/1992 Kenney
5,301,999 A 4/1994 Thompson et al.
5,339,847 A 8/1994 Kanter et al.
5,347,667 A 9/1994 Schwarz et al.
5,515,564 A 5/1996 Lyons
5,551,110 A 9/1996 Armstrong et al.
5,579,797 A 12/1996 Rogers
5,638,846 A * 6/1997 Basso ..... A45B 25/02 135/19.5
5,655,558 A * 8/1997 Child ..... E04H 15/48 135/100
5,682,915 A 11/1997 Martin
5,738,129 A 4/1998 Vogt
5,743,283 A 4/1998 Horvath
5,758,889 A 6/1998 Ledakis
5,823,217 A 10/1998 Rice
5,826,604 A 10/1998 Hartmann
5,884,645 A 3/1999 Chen et al.
5,947,139 A 9/1999 Lebrecht
6,082,383 A 7/2000 Wilson
6,116,256 A * 9/2000 Pawsey ..... A45B 19/00 135/120.3
6,173,725 B1 1/2001 Garth
6,234,185 B1 * 5/2001 Tidd ..... A45B 25/02 135/19.5
6,405,742 B1 6/2002 Driscoll
6,571,814 B2 6/2003 You
6,668,407 B1 12/2003 Reitzel
6,711,769 B1 3/2004 Jane-Prats
6,904,923 B2 * 6/2005 Chai ..... B60J 1/2011 135/21
6,941,958 B1 9/2005 Sobek et al.
7,278,245 B2 * 10/2007 Rouse ..... A47B 3/002 108/118
7,347,217 B2 3/2008 Bree et al.
7,814,920 B2 10/2010 Lenahan
7,992,581 B2 8/2011 Hoogendoorn
9,016,300 B1 4/2015 Gillespie
9,066,512 B2 * 6/2015 Nolz ..... F41A 23/14
2001/0050097 A1 * 12/2001 Fazel ..... A45B 25/24 135/15.1
2002/0112749 A1 8/2002 Ludka
2003/0111102 A1 6/2003 Henley et al.
2005/0056309 A1 3/2005 Bree et al.
2005/0077018 A1 4/2005 Kimpton
2005/0109383 A1 5/2005 Pham
2005/0199774 A1 9/2005 Reese
2006/0107980 A1 5/2006 Freestone
2006/0219279 A1 10/2006 Kaufman
2007/0028358 A1 2/2007 Baek et al.
2007/0034342 A1 2/2007 Fill
2011/0099692 A1 5/2011 Essex
2012/0180832 A1 7/2012 Zheng
2013/0019914 A1 1/2013 Tung
2013/0098410 A1 4/2013 Prasannakumar et al.
2013/0125942 A1 5/2013 Stoll
2013/0174826 A1 * 7/2013 Faherty ..... F41B 5/1496 124/88
2015/0083172 A1 3/2015 Boal
2015/0181991 A1 7/2015 Strong

* cited by examiner

COLLAPSIBLE SUN SHADE

This non-provisional application claims the benefit of the priority filing date of provisional application No. 62/203,228, filed on 10 Aug. 2015.

BACKGROUND

Sun shading apparatus and sun shading devices are known in the art. These devices are typically large apparatus for either casting a shadow over a user's entire body, or comprise an enclosure for surrounding a user, thus preventing the sun's rays from reaching them. Pop-up sun shading apparatus are also known, and are usually designed either to shield the entire body of a user, or may comprise umbrella-like structures that a user must carry. In addition to being cumbersome to carry, these apparatus often have short operational life spans. Although umbrella-like structures are appropriate for shielding only a portion of a user's body, they are usually made for carrying, and are inconvenient for placing over a user in a prone, sun bathing position. These apparatus also involve complex mechanics for opening and closing, which makes them expensive to manufacture and malfunction easily. Because they are typically not aerodynamic, they also present a safety hazard in heavy winds, which may cause them to blow them away and cause breakage or injury.

Sunbathers frequently desire even sun exposure when tanning during summer months. Although sunbathers desire even tanning over most portions of the body, they frequently wish to avoid full sun exposure on the head and face, and upper chest areas. This is because the head, face and upper chest require less tanning as they are naturally exposed to sunlight on a daily basis, and due to the deleterious effects of sunlight (i.e., UV rays) on a sunbather's skin. Conventional sun shading apparatus, being either too large, are thus inconvenient for selective body exposure, or are cost prohibitive due to complicated mechanics and manufacturing requirements that fail to address the needs of sun bathers desiring an inexpensive, easy to use shading apparatus for the head and face while sunbathing.

Hence, what is needed is a sun shading device that makes it easy for a user to block direct sunlight, and in particular UV radiation from sunlight, selectively, on sensitive areas of the user's body (e.g., face and neck). There is also a need for a sun shading device designed to quickly and automatically pop up, opening to its fill and final configuration with a very simple strap release motion and minimal effort on the part of a sunbather. There is also a need for a sun shading device that is aero-dynamic and which cannot be easily caught by the wind. There is also a need for a sun shading device that collapses and folds for easy transport and storage, thereby encouraging sunbathers to use it more often. There is also a need for a sun shading device that is inexpensive to manufacture, and which can be easily adapted for branding or other promotional purposes.

SUMMARY

An automatically opening sunshade for shading a person includes a flexible connector made of a deformable material biased to a specific shape. The flexible connector includes a central hub, and has a post anchor, a first arm anchor and a second arm anchor extending from the central hub. The first arm anchor and the second arm anchor preferably extend from the central hub in a substantially co-planar arrangement. The flexible connector includes a plurality of cut-outs, including a post cut-out between the post anchor and the central hub, a first arm cut-out and a second arm cut-out are each located between the first arm and the central hub, and the second arm and the central hub, respectively. A post extends from the post anchor, a first arm extends from the first arm anchor and a second arm extends from the second arm anchor, with a shade panel held by the first arm and the second arm. The flexible connector is molded such that the first arm, second arm, and shade panel, are held substantially horizontal under their own weight and the post is substantially vertical.

The flexible connector may include a surface pattern. Similarly, the central hub may include a display surface for displaying advertising indicia. The post anchor, the first arm anchor and the second arm anchor may all extend from the central hub in a substantially co-planar arrangement. The post cut-out, the first arm cut-out and the second arm cut-out preferably comprise thinned sections of the flexible connector. Additionally, the central hub may be thinner than the post anchor, the first am anchor and the second arm anchor. In one embodiment, the first arm anchor and the second arm anchor are molded substantially perpendicular to the post anchor. Preferably the shade panel is triangular and includes stitched piping for accepting the first arm and the second arm. The shade panel may include at least one side flap. Preferably a releasable strap is positioned to surround the post, the first arm, and the second arm, securing them in a substantially parallel orientation under pressure by the flexible connector when brought together.

In a an alternative embodiment, an automatically opening sunshade for shading a person includes a flexible connector made of a resilient deformable material biased to a specific shape, with the flexible connector having a central hub. The flexible connector also includes a post anchor, a first arm anchor, a second arm anchor, and third arm anchor, all extending from the central hub. The first a anchor and the second arm anchor extending from the central hub in a substantially coplanar arrangement. The flexible connector includes a plurality of cut-outs; a first arm cut-out between the first arm and the central hub, a second arm cut-out between the second arm and the central hub, and a third arm cut-out between the third arm and the central hub allow them to bend relative to the post anchor.

A post extends from the post anchor, a first arm extends from the first arm anchor, a second arm extends from the second arm anchor and a third arm extends from the third arm anchor. A shade panel is held by the first arm and the second arm and the flexible connector is molded such that the first arm and the second arm are held substantially horizontal under their own weight and the post is substantially vertical when the sunshade is open.

Similar to the first embodiment, the flexible connector may have a surface pattern. The central hub may include a display surface. The first arm cut-out, the second arm cut-out, and the third arm cut-out may represent thinned sections of the flexible connector, allowing them to bend relative to the post anchor. In this embodiment, the third arm is preferably held slightly higher than the first arm and the second arm. Additionally, the post anchor may be molded substantially perpendicular to a plane defined by the first arm anchor and second arm anchor.

Preferably, the shade is triangular in plan view. The shade panel may include stitched piping for accepting the first arm, the second arm, and the third arm. The shade panel may also include at least one side flap. The shade panel also includes at least one releasable strap, and the strap positioned to surround the post, the first arm, the second arm, and the third arm, securing them in a substantially parallel orientation under pressure by the flexible connector when the sunshade is closed.

In another alternative embodiment, a pop-up sunshade includes a flexible connector having a post anchor, a first arm anchor and a second arm anchor. A post extends from the post arm anchor, a first arm extends from the first arm anchor, and a second arm extends from the second arm anchor. A shade panel is held by the first arm and the second arm, the shade panel extending between the first arm and the second arm. The first arm anchor and the second arm anchor preferably extend from the flexible connector at an oblique angle, such that the first arm, the second arm and an elongated edge of the shade panel create a planarly triangular shape. A releasable strap extends from the shade panel, the releasable strap surrounding and confining the post, the first arm, the second arm, and the shade panel, such that releasing the strap causes the first arm and the second arm to automatically carry the shade panel away from the post, until the first arm, the second arm and the shade panel are oriented substantially ninety degrees relative to the post when the post is vertically oriented.

DETAILED DESCRIPTION

The following description is presented to enable any person skilled in the art to make and use the invention, and is provided n the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein. The disclosed device is user-friendly, easy to transport and store, inexpensive to make, and is designed to be aerodynamic and to protect an area of the body which is more susceptible to excess sun. Using the properties of rubber-like material, the device pops open to its full configuration for the user by releasing a single strap to protect the user against sun, and alternatively, against rain.

Figure 1:
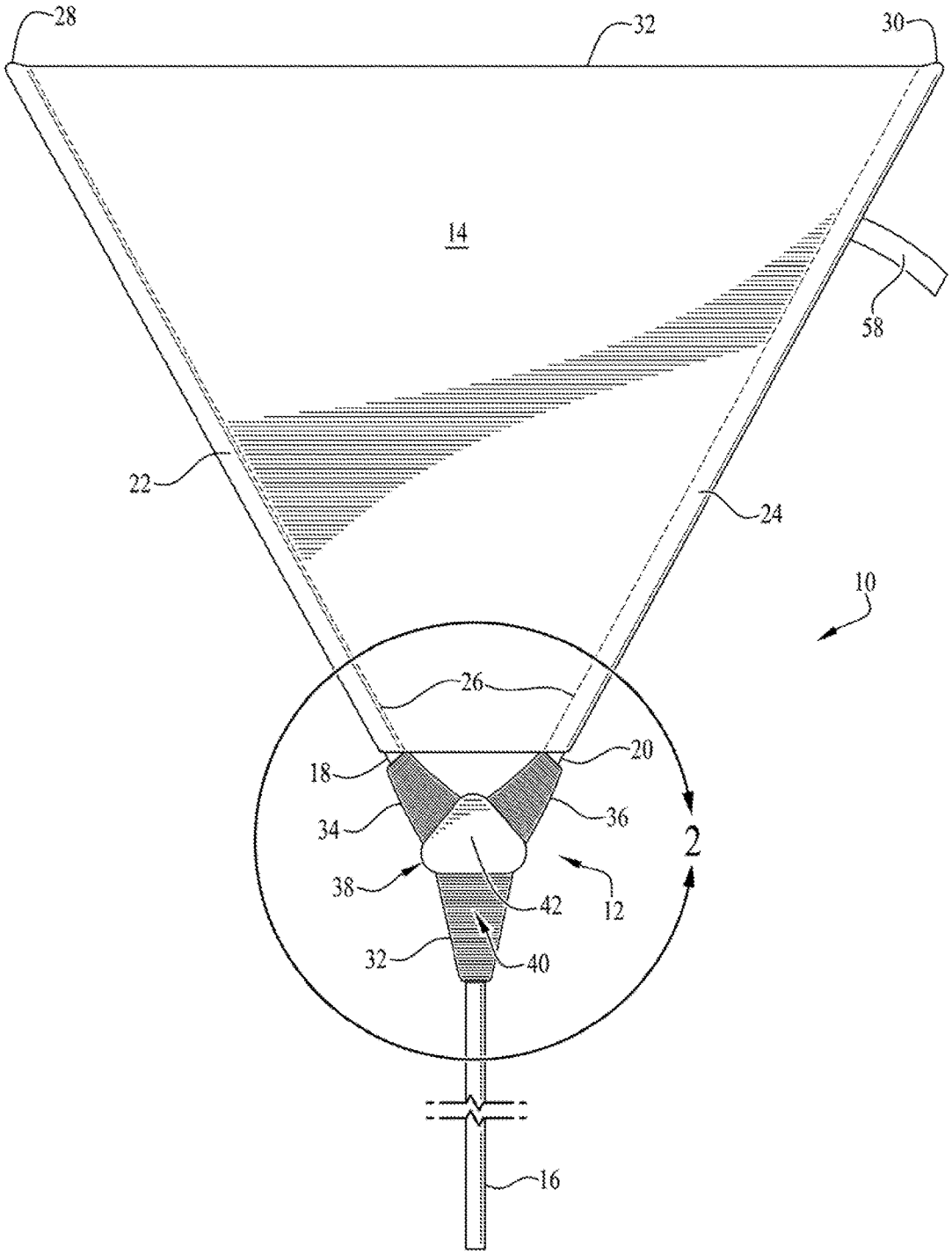
FIG. 1 illustrates a plan view of a collapsible pop-up sunshade.

Referring to FIG. 1, the sunshade 10 is shown in plan view. The sunshade 10 comprises a flexible connector 12 and a canopy-like shade panel 14. The flexible connector 12 is preferably made of a malleable yet resilient material biased to a specific shape, allowing the flexible connector 12 to be manipulated (i.e., deformed) under bending pressure and thus resume its original shape when released. Some examples of suitable materials may include rubber, silicon, or similar materials now known or developed in the future having rubber-like properties. The shade panel 14 is preferably made of a light weight, cloth-like material that may be waterproof, and may be made with varying degrees of opacity, thus allowing some light to penetrate the shade panel 14 while blocking harmful UV rays. The shade panel 14 also blocks sunlight without blocking the view of the user's surroundings or air currents. The shade panel 14 is also aerodynamically shaped to resist the force of oncoming winds and thus will remain in place (i.e., will not fly away) unlike conventional shading devices. The aerodynamic shape of the shade panel 14 may also be useful when carrying the sunshade 10 because it fans out behind the user, i.e., the shade panel 14 will tend to glance off of objects without stopping forward movement of the sunshade 10. The shade panel 14 may also have indicia (not shown), such as designs, logos, or similar promotional indicia.

A post 16 extends from the connector 12 and is used to anchor the sunshade 10 in the sand or ground (not shown). The post 16 is preferably sufficiently elongated to hold the sunshade 10 (and specifically the shade panel 14) sufficiently above a user's head and face with enough headroom so as to avoid touching the user, while casting an appropriately sized shadow thereon. The post 16 is preferably made of a lightweight yet resilient material that avoids bending, thereby allowing a user to manually insert the post 16 into a surface, such as the ground (including sand, earth, or even snow). To facilitate insertion into the ground, the post 16 may have a sharpened end (not shown) opposite its connection to the flexible connector 12. The post 16 may also be of a variety of cross-sectional profiles (round, square, triangular, etc.), and an adaptor such as a plastic or metal pipe (not shown) can be pushed in to sand or ground, allowing the bottom tip of the post 16 to be inserted in to its hole. This adaptor can aid with the height adjustment of the sunshade 10, and make it easy to adjust and rotate the shade panel's 14 position according to sun's moving angle, or hold it steady when the wind changes direction, so the sunshade 10 won't rotate out of place. The sunshade 10 can also be mounted on beach chairs and or a moving bike, or motorcycle. To promote recycling and avoid the use of non-renewable materials, some exemplary materials used for the post 16 (and the first arm 18 and the second arm 20) may include a lightweight wood, such as bamboo or a similar organic material, or plastic rods or tubes made of recycled materials or composite materials. In one alternative embodiment, the first arm 18, the second arm 20 and the shade panel 14 may be formed as a single unit of pressed material such as plastic.

The shade panel 14 is connected to the flexible connector 12 by a first arm 18 and a second arm 20. The first arm 18 and the second arm 20 extend from the flexible connector 12 at an angle, thus spreading out shade panel 14 to form a triangular shade panel 14 over a user. The first arm 18 is preferably substantially similar to the second arm 20 in length and thickness (including being identical to the second arm 20) to promote an aesthetic, even appearance to the sunshade. Also to provide effective anchoring and added resiliency, the shade panel preferably includes a first stitched piping 22 and a second stitched piping 24 formed with stitches 26 or similar seam forming structure.

The first stitched piping 22 and second stitched piping 24 are preferably sized to house the first arm 1S and the second arm 20 tightly enough to retain the shade panel 14, but to allow sliding movement, thus enabling users to exchange it with a shade panel 14 having a different color or indicia. To prevent the shade panel 14 from sliding down the first arm 18 and the second arm 20 toward the flexible connector 12, the first stitched piping 22 has a first terminal end 28 and the second stitched piping 22 has a second terminal end 30, preferably defining extremities of an outer edge 32 of the shade panel 14, but may also extend from the post 16, the first arm 18, or the second arm 20.

Like the post 16, the first arm 18 and the second arm 20 are preferably made of a lightweight yet resilient material that avoids bending (including a lightweight wood material such as bamboo or similar organic material and/or plastic rods or tubes made of recycled materials or composite materials), thereby ensuring that the shade panel 14 is held taut when the sunshade 10 is open over a user. In one preferred embodiment, the post 16, first arm 18 and second arm 20 are made of the same material, and are of the same thickness, although the post 16 may have a greater length and thickness depending on the size of the shade panel 14 and depth to which the post 16 is driven into the ground.

The flexible connector 12 comprises the operational portion of the sunshade 10, and includes a post anchor 34, a first arm anchor 36, and a second arm anchor 38, all extending from a central hub 40. The post 16 extends into the post anchor 34, the first arm 18 extends into the first arm anchor 36 and the second arm 20 extends into the second arm anchor 38. The post 16, first arm 18 and second arm 20 extend into the flexible connector 12 a distance keeping them securely inserted into the flexible connector 12 while allowing the flexible connector 12 to bend until the post 16, first arm 18 and second arm 20 are brought together under deflection forces. Thus, the sunshade 10 can be stored in a collapsed configuration (see FIG. 4), and will automatically open when removed from storage with no installation of the post 16, first arm 18 and second arm 20 into the flexible connector 12 necessary prior to opening. A strap 58 is provided for securing the sunshade 10 in a collapsed configuration. In one preferred embodiment, the strap wraps the shade panel 14 around the post 16, the first arm 18 and the second arm 20, to hold them securely together. The strap 58 may include a hook and latch closure, or any other type of closure suitable for holding the strap 58 secure. By releasing the strap 58, the sunshade 10 will automatically open to its full configuration for use. In one preferred embodiment, the strap 58 extends from the shade panel 14.

The post anchor 34, first arm anchor 36 and second arm anchor 38 may be formed to have a surface pattern 42, including a striped surface pattern 42 for aesthetic purposes, or for reducing the likelihood of the flexible connector 12 tearing under bending strain. In one preferred embodiment the central hub 40 comprises a display surface 44, providing a second location (in addition to the shade panel 14) for indicia, such as designs, logos, or similar promotional images. The display surface 44 allows the sunshade 10 to function as an effective marketing tool even when the sunshade 10 is deformed into its collapsed configuration, since the display surface 44 remains readily visible with the shade panel 14 collapsed, and even when the collapsed sunshade 10 is inserted into an open ended holder, such as a cardboard or similar tube, the display surface 44 is visible.

Figure 3:
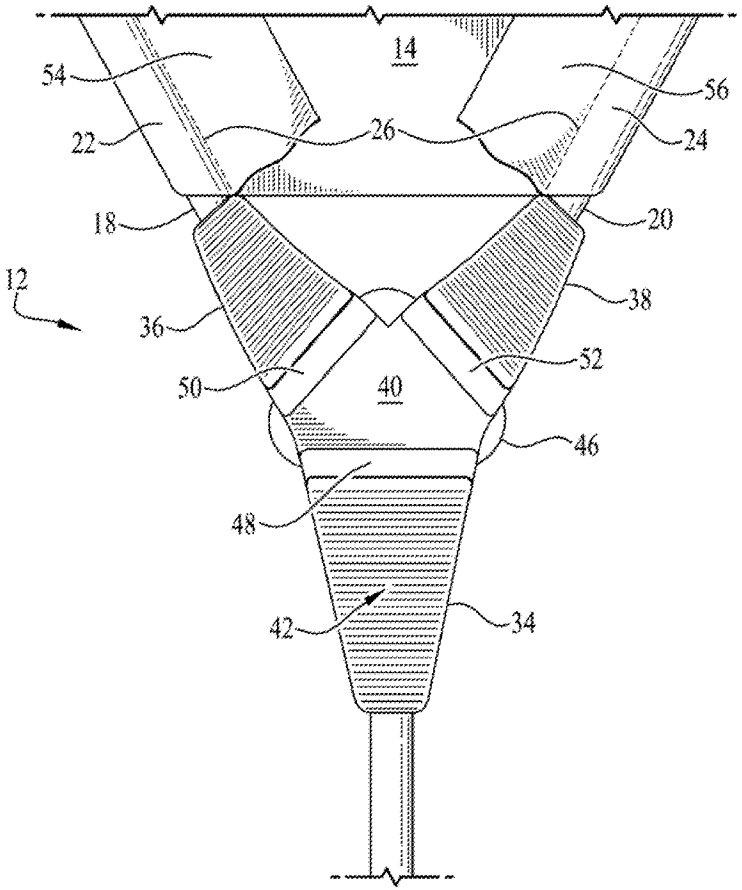
FIG. 3 illustrates an enlarged plan view of the bottom side of a flexible connector of the sunshade.
Figure 2:
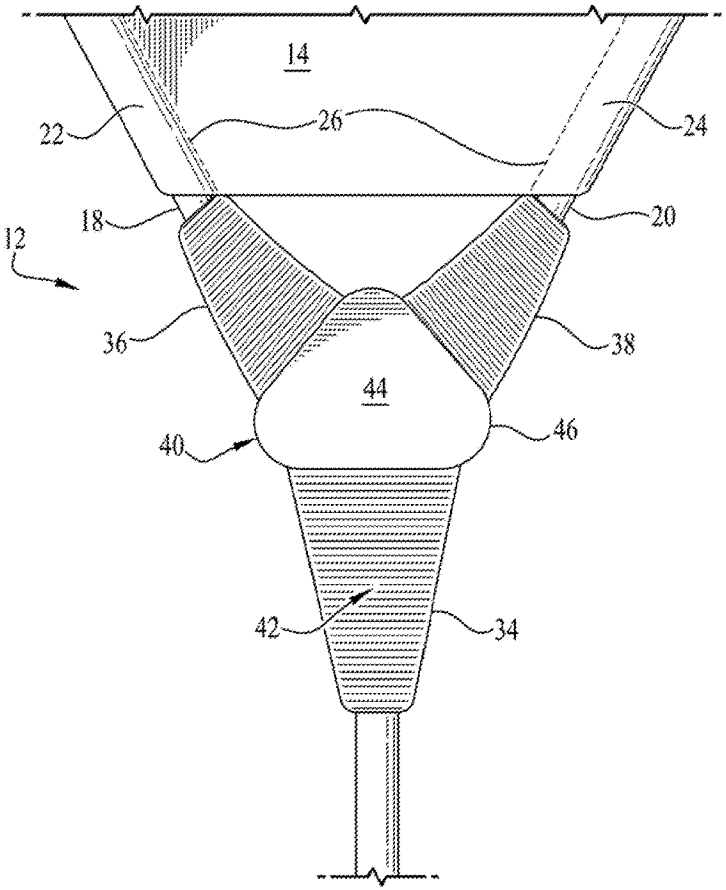
FIG. 2 illustrates an enlarged plan view of the top side of a flexible connector of the sunshade.

Referring to FIGS. 2 and 3, the flexible connector 12 is shown in top plan view (FIG. 2) and bottom plan view (FIG. 3). In one embodiment, the display surface 44 may be surrounded by a flange 46, to provide a more attractive and eye-catching appearance to the sunshade 10, causing persons viewing the sunshade 10 to focus on the display surface 44 and any messages displayed thereon. It is anticipated advertising logos or brands will be placed mostly on the shade panel 14. While logos and names may be placed on the central hub 40, the shade panel 14 is the main location for advertisements. Reverse of the display surface 44, the flexible connector preferably comprises a post cutout 48 where the post anchor 34 joins the central hub 40, a first arm cutout 50 where the first arm anchor 36 joins the central hub 40, and a second arm cutout 52, where the second arm anchor 38 joins the central hub 40. Due to the reduced thickness of the flexible connector 12 at the post cutout 48, first arm cutout 50 and second arm cutout 52, they govern (in concert with the flexural strength of the material comprising the flexible connector 12) the deflection force needed to cause the first arm 18 and second arm 20 to deflect relative to the post 16 in opening the sunshade 10 and holding the shade panel 14 open.

Preferably, the post cutout 48, first arm cutout 50 and second arm cutout 52 are sized such that when the post 16, first arm 18 and second arm 20 are released from a bound-together configuration, the first arm 18 and second arm 20 rise to a substantially ninety degree angle relative to the post 16 (i.e., when the post 16 is vertical, the first arm 18 and second arm 20, and thus the shade panel 14 as well, are held substantially horizontal). In the preferred embodiment, all bending in the sunshade 10 occurs at the flexible connector 12. These cut outs (48, 50, 52) are placed on these areas to allow and facilitate easier collapsing of all the arms (16, 18, 20), yet are calculated to not reduce the structural support needed to keep the shade panel 14 at its horizontal position, minimum of 90 degrees relative to the standing leg or arm.

As shown in FIG. 3, the shade panel 14 may include a first side flap 54 and second side flap 56 extending beyond the stitches 26 of the first stitched piping 22 and second stitched piping 24, respectively. The first side flap 54 and second side flap 56 may be printed with indicia, like the shade panel 14, thus (with the shade panel 14 horizontal) they provide additional, vertical, display spaces on the sunshade 10. The first side flap 54 and second side flap 56 also provide an increased shaded area for a user when the sun is at an angle.

Figure 4:
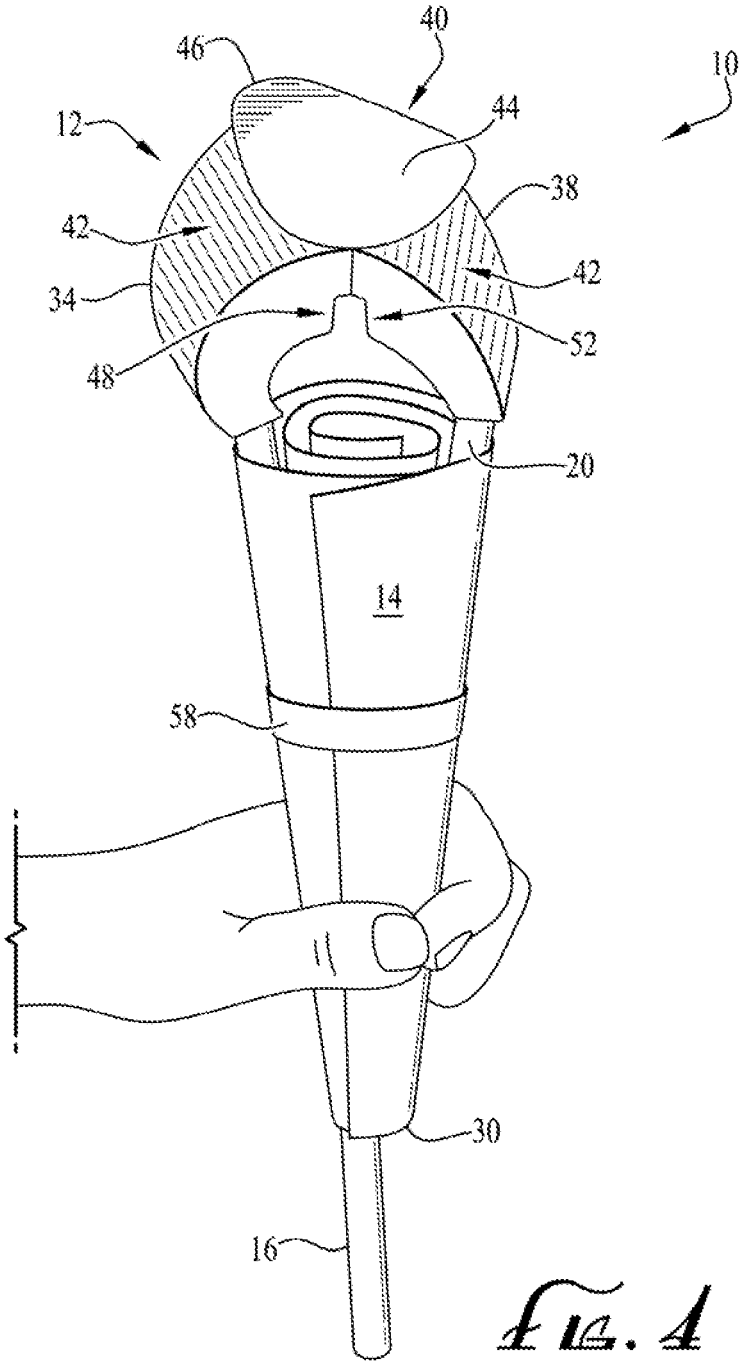
FIG. 4 illustrates the sunshade in a collapsed configuration and held by a user.

Referring to FIG. 4, the sunshade 10 is shown in its collapsed configuration. The sunshade 10 can be held in its collapsed position by the strap 58 and stored away. The sunshade 10 may also be held in a holder (not shown), such as a tube. Alternatively the post 16, first arm 18 and second arm 20 may be tied together with a band, such as a rubber band (not shown). In the collapsed position, the display surface 44 remains visible for displaying a logo. When a user retrieves the sunshade 10, the user may hold it in the collapsed position as shown in order to conveniently carry or transport the sunshade 10. Once the user reaches a desired location for use, such as at a beach, park, or similar sun exposed area, the user simply unfixes the strap 58 and the shade panel 14 pops open into its ready-to-use configuration. The user can then drive the post 16 into the ground. Since the post 16 is longer than the first arm 18 and second arm 20, the user may drive the post into the ground far enough to anchor the sunshade 10 without the first arm 18 and second arm 20 touching the ground. Alternatively, the post may simply be anchored in any suitable gripping holder, such as a spring loaded clip, common in the art, thus allowing the sunshade 10 to be mounted on a beach chair, or moving bike or motorcycle. With the post 16 sufficiently anchored in position, the user can release the sunshade 10, allowing it to automatically open due to the resiliency of the flexible connector 12.

Figure 5:
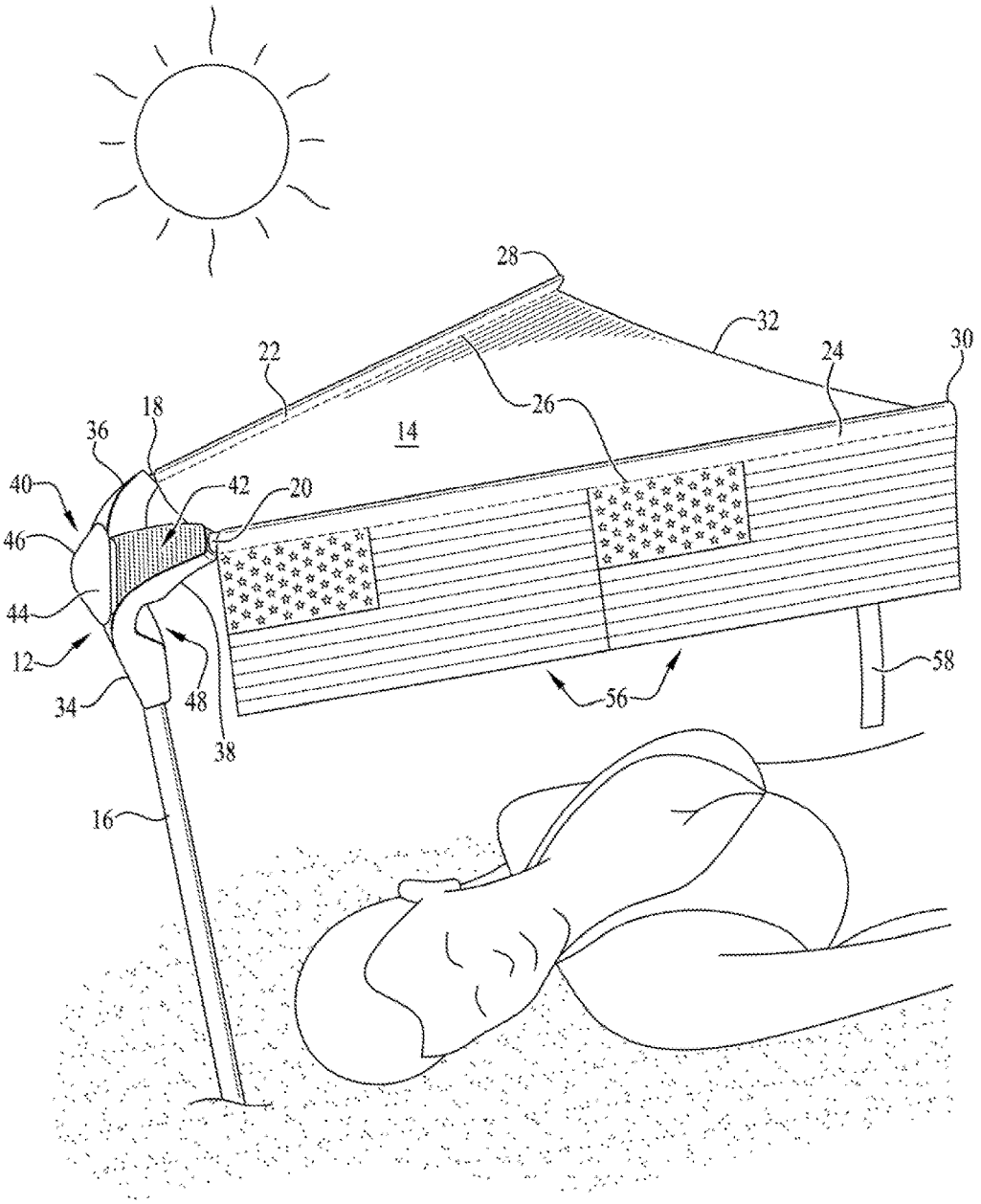
FIG. 5 illustrates the sunshade in an open configuration and in use by a user in a prone position.

Referring to FIG. 5, once the sunshade 10 is secured in position and released by a user, tension in the flexible connector 12 causes it to lift the first arm 18 and second arm 20, and by extension, the shade panel 14 to their full horizontal position. Because the first arm anchor 36 and second arm anchor 38 extend from the central hub 40 at an angle, when the first arm. 18 and the second arm 20 lift upward, they also move outward, away from one another, thereby pulling the shade panel open 14. Similarly, when the first arm 18 and second arm 20 are forced down to join the post 16, they come together, allowing the shade panel 14 to collapse. The illustrated embodiment shows a cloth-like shade panel 14, that wraps around the post 16, the first arm 18 and the second arm 20 when, the sunshade 10 is collapsed. The shade panel 14 could be made of a more resilient material, allowing it to open and close in a predictable manner, for example using accordion folds.

Additionally, the shade panel 14 may include larger second side flaps 56 on both sides or optionally on only one side, which increase the area shaded by the sunshade 10, and may be emblazoned with decorative or promotional indicia. In the illustrated embodiment, a flag pattern is shown, which may be advantageous for summer Fourth of July celebrations. With the post 16 inserted in the ground or held by a holder, and the first arm 18 and second arm 20 released and allowed to lift the shade panel 14 to a preferably substantially horizontal position, a user may shade a more sun-sensitive portion of the user's body, such as the face and neck, while exposing other desired portions of the user's body to full sun when sunbathing. Its aerodynamic shape makes it also suitable to be mounted on moving bikes and motorcycles, thus resisting incoming wind when mounted either stationary or while in motion.

Figure 6:
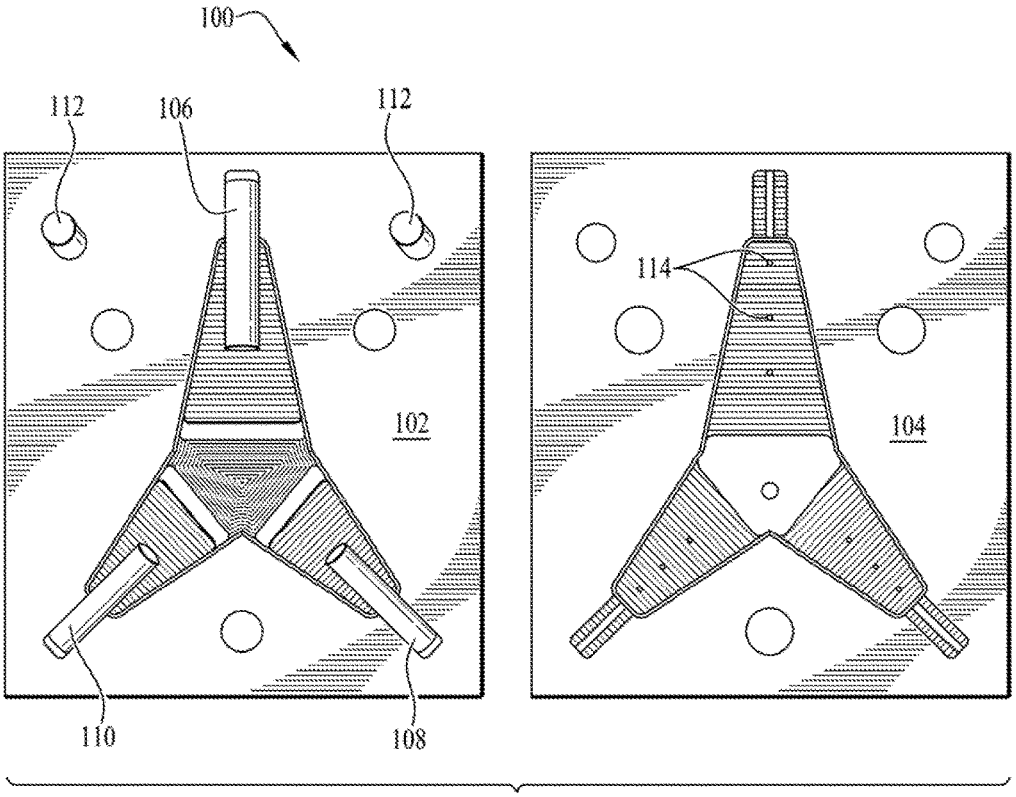
FIG. 6 illustrates a plan view of two halves of a mold for making the flexible connector.

Referring to FIG. 6, the sunshade 10 is designed to be easily and inexpensively manufactured, allowing it to be sold at a very low cost, for purchase or as a promotional item given away with an accompanying product. The only materials required for forming the sunshade 10 are the post 16, first arm 18, second arm 20, shade panel 14, and the flexible connector 12. The post 16, first arm 18 and second arm 20 can be easily formed of simple wooden (or alternatively plastic or metal) dowels of appropriate length. The shade panel 14 is also easily formed, as a simple triangular piece of cloth or cloth-like material (including UV ray blocking materials), into which the first stitched piping 22 and second stitched piping 24 are incorporated using conventional commercial sewing techniques. Alternatively to reduce manufacturing costs, the two arms 16, 18 and the shade panel 14 can be constructed as one piece when pressed together in the factor, and can be made from very light weight materials, similar to those used for beach kites.

To make the flexible connector 12 both inexpensive and easy to manufacture, as well as low cost, it is anticipated the flexible connector 12 will be formed as a single piece of flexible resilient material that can be easily molded according to conventional techniques. A mold 100 for the flexible connector 12 includes a first half 102 and a second half 104, preferably made of aluminum or similar material. Prior to molding, a post spacer 106, first arm spacer 108 and second arm spacer 110 are inserted into the first half 102 to create receptacles in the post anchor 34, first arm anchor 36 and second arm anchor 38. Registration tabs 112 allow the first half 102 and the second half 104 to be repeatedly properly aligned, and air holes allow the material that will comprise the flexible connector 12 to be introduced and allow air to escape during molding. Air holes 114 allow air to escape the mold 100.

Figure 7:
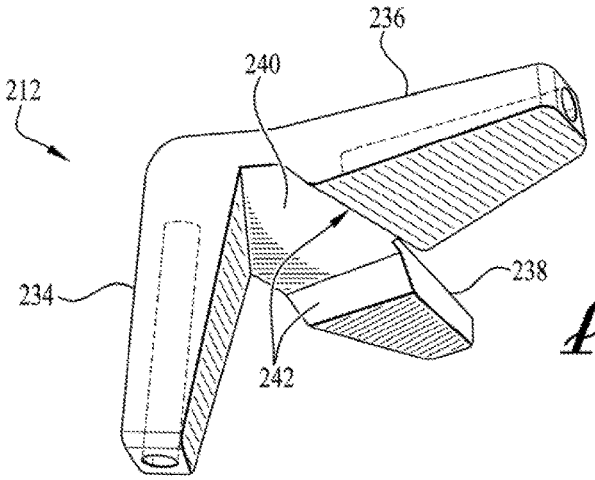
FIG. 7 illustrates a perspective view first alternative embodiment flexible connector for use in creating a first alternative embodiment collapsible pop-up sunshade.

Referring to FIG. 7, a flexible connector 212 for a first alternative embodiment sunshade (not shown) is illustrated. In this embodiment, flexing of the flexible connector 212 is accomplished solely using a second embodiment first arm anchor 236 and a second embodiment second arm anchor 238. A second embodiment post anchor 234 allows the post 16 (not shown in this view) to be inserted almost all the way to a second embodiment central hub 240. This second embodiment post anchor 234 provides a fixed semi-ninety degree angle between the first arm anchor 236 and the second arm anchor 238 as molded. Since the post anchor 234 is molded in its upright position, the post anchor 234 doesn't bend when the first arm anchor 236 and second arm anchor 238 bend together.

When using the first alternative embodiment flexible connector 212, the post 216 (not shown) keeps the post anchor 234 from bending when the sunshade is closed and opened. Instead, two slanted regions 242 are positioned at the junction of the central hub 240 and first arm anchor 236, and the central hub 240 and second arm anchor 238. The slanted regions 242 serve the same purposes as the first arm cutout 50 and second arm cutout 52 in providing the appropriate tension in the flexible connector 212 for holding the shade panel (not shown) horizontal when the post (not shown) is anchored in vertical orientation.

Figure 8:
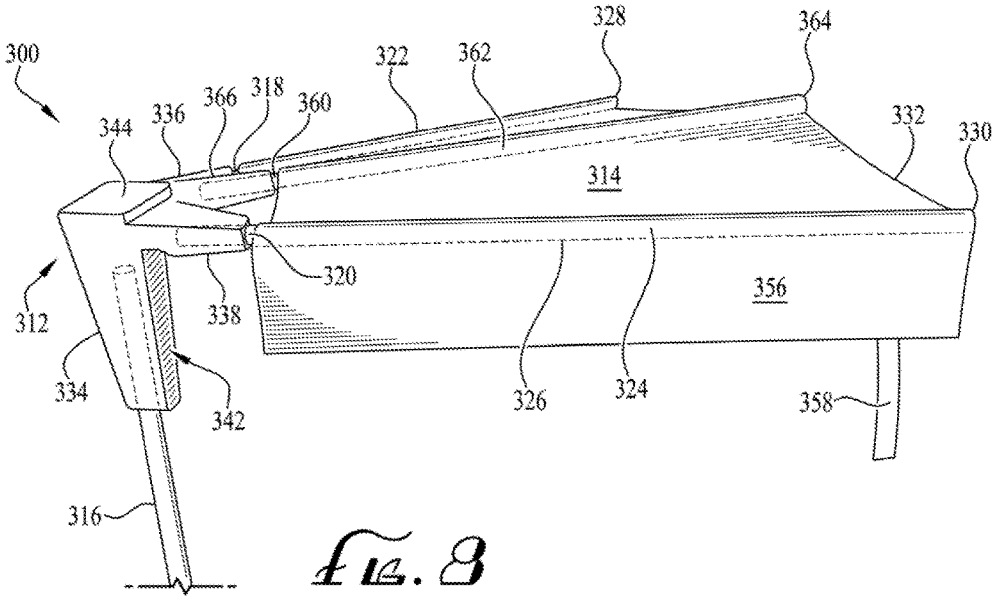
FIG. 8 illustrates a perspective view of a second alternative collapsible pop-up sunshade suitable for sun or rain.
Figure 9:
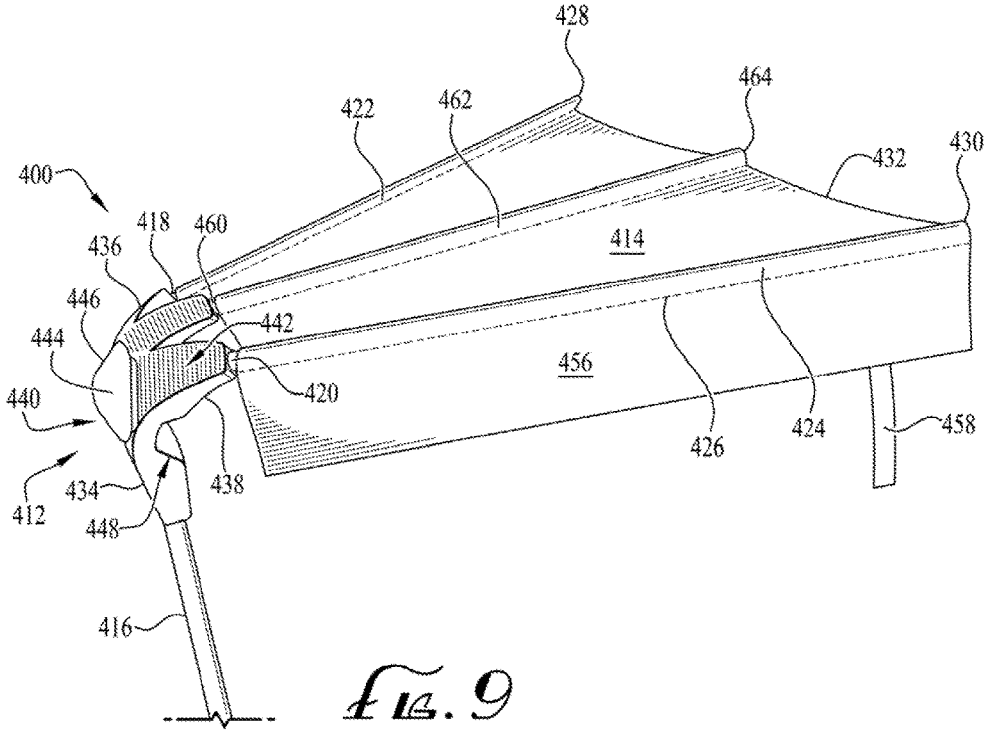
FIG. 9 illustrates a perspective view of a third alternative embodiment collapsible pop-up sunshade suitable for sun or rain.

FIGS. 8 and 9 show a second alternative embodiment sunshade 300 and a third alternative embodiment sunshade 400, respectively. The second alternative embodiment sunshade 300 is a flexible connector 312 similar to the first alternative embodiment flexible connector 212, and includes a shade panel 314, a post 316 molded substantially perpendicular to a first arm 318 and a second arm 320. Also having first stitched piping 322, second stitched piping 324, stitching 326, first terminal end 328, second terminal end 330, outer edge 332, post anchor 334, first arm anchor 336, and second arm anchor 338. It may also have a surface pattern 342, display surface 344, side flap 356, and strap 358 among other similar features. The strap 358 (and 458) preferably wraps the shade panel. 31.4 (and 414) around the post 316 (and 416), the first arm 318 (and 418), the second arm 320 (and 420) and the third arm 360 (and 460) to hold them securely together.

Aside from the orientation of the post anchor 334, another major difference between the first alternative embodiment flexible connector 212 and second alternative embodiment flexible connector 312 is the presence of a third arm 360, third arm stitched piping 362 on the shade panel 314, with a third terminal end 364 confining it therein. The third arm 360 is supported by a third arm anchor 366 extending between the first arm anchor 336 and second arm anchor 338 through stitched piping 362. Preferably the third arm 360 extends above the first arm 318 and second arm. 320 to provide extra support. This embodiment is meant for situations where protection from rain may also be desired by a user. The third arm anchor 366 holds the third arm 360 slightly higher than the first arm 318 and second arm 320, to help channel water off the shade panel 314.

The fourth alternative embodiment sunshade 400 also includes a flexible connector 412, shade panel 414, post 416, first arm 418, second arm 420), first stitched piping 422, second stitched piping 424, stitches 426, first terminal end 428, second terminal end 430, outer edge 432, post anchor 434, first arm anchor 436, second arm anchor 438, and strap 458. The fourth alternative embodiment sunshade 400 is different in that, like the main embodiment sunshade 10, it has s central hub 440 with a display surface 444, and may have a flange 446. Also, like the main embodiment sunshade 10 it has a post cutout 448 to allow the post 416 along with the first arm 418 and second arm 420 to bend together. Like the third alternative embodiment sunshade 300, the fourth alternative embodiment sunshade 400 includes a third arm 460 extending through stitched piping 462 to a terminal end 464 and extending above the first arm 418 and second arm 420 to provide extra support.

The structure of the sunshade 10 having been shown and described, its method of manufacture and use will now be discussed.

In order to manufacture the sunshade 10, the first half 102 of the mold 100 is fitted with the post spacer 106, first arm spacer 108 and second arm spacer 110. Alternatively, the first half 102 of the mold 100 may have these features incorporated directly therein. The first half 102 and second half 104 of the mold are brought together using the registration tabs 112 to easily and accurately align the first half 102 and second half 104. Once the first half 102 and second half 104 are secured together, the material forming the flexible connector 12 is pumped into the mold through the injection hole 116 while allowing air to be displaced and escape out to the air holes 114. Once the flexible connector 12 is cured, the first half 102 and second half 104 are separated and the flexible connector 12 dislodged from the mold 100.

The finished flexible connector 12 may be colored according to presence, preferably by coloring the material comprising prior to molding, due to surface flexing in use. A logo or similar indicia may be applied to the display surface 44 of the central hub 40 according to preference. Simultaneously, or at another predetermined time, the shade panel 14 is formed, comprising a triangular shaped piece of material with the first stitched piping 22 and second stitched piping 24 formed therein using stitches 26, adhesive, or another similar method (including all pressed as one piece). In the process a first side flap 54 and second side flap 56 may also be formed. The first arm 18 and second arm 20 are inserted into the first stitched piping 22 and second stitched piping 24, respectively, until the first arm 18 reaches the first terminal end 28 and the second arm 18 reaches the second terminal end 30 at various lengths and heights. The first alternative embodiment sunshade 200 and second alternative embodiment sunshade 300 may be manufactured in a similar manner, simply by changing the shape of the mold forming the flexible connector.

To assemble the sunshade 10, a manufacturer simply inserts the post 16 in to the post anchor 34. The first arm 18 and second arm 20 are inserted into the first arm anchor 36 and second arm anchor 38, respectively, and the shade panel is affixed to the first arm 18 and second arm 20 by inserting them into the first stitched piping 22 and second stitched piping 24, respectively until they reach the outer edge 32 of the shade panel 14. Because the flexible connector is pliable, the first arm 18 and the second arm 20 can be easily manipulated into the first stitched piping 22 and second stitched piping 24. Additionally, because the flexible connector is resiliently pliable, once the first arm 18 and the second arm 20 are in place, they spread apart, preventing them from dislodging from the shade panel 14.

As an additional inexpensive and easy to accomplish step of manufacturing, a surface pattern 42 may be incorporated into the mold 100 for creating an aesthetic texture to the flexible connector 12, and a display surface (including an artful or branded promotional, image) may be painted, printed, stamped or otherwise affixed to the display surface. Additionally, the shade panel 14 may be imprinted with artful or promotional indicia as well as the first side flap 54 and second side flap 56, thus making the sunshade 10 an inexpensive and effective marketing tool.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. An automatically opening sunshade, comprising;
a flexible connector made of a resilient deformable material, the flexible connector having a central hub;
the flexible connector further comprising a post anchor, a first arm anchor and a second arm anchor, the first arm anchor and the second arm anchor extending from the central hub in a substantially co-planar arrangement;
the flexible connector further comprising a plurality of cut-outs between the post anchor and the central hub, the first arm and the central hub, and the second arm and the central hub, the plurality of cut-outs comprising thinned sections of the flexible connector;
a post extending from the post anchor, a first arm extending from the first arm anchor and a second arm extending from the second arm anchor;
a shade panel held by the first arm and the second arm; and
wherein the plurality of cut-outs are sized such that the first arm, the second arm and the shade panel are disposed substantially horizontally under their own weight if the post is substantially vertically.

2. The sunshade of claim 1 wherein the flexible connector comprises a surface pattern.

3. The sunshade of claim 1 wherein the central hub comprises a display surface.

4. The sunshade of claim 1 wherein the post anchor, the first arm anchor and the second arm anchor all extend from the central hub in a substantially co-planar arrangement.

5. The sunshade of claim 1 wherein the central hub is thinner than the post anchor, the first arm anchor and the second arm anchor.

6. The sunshade of claim 1 wherein the shade panel is triangular.

7. The sunshade of claim 1 wherein the shade panel comprises stitched piping for accepting the first arm and the second arm.

8. The sunshade of claim 1 wherein the shade panel comprises at least one side flap.

9. The sunshade of claim 1 wherein the shade panel comprises at least one releasable strap, the strap sized and positioned such that the strap surrounds the post, the first arm, and the second arm when brought together.

10. The sunshade of claim 1 wherein the shade panel comprises at least one side flap.

11. The sunshade of claim 1 wherein the shade panel comprises at least one releasable strap, the strap positioned to surround the post, the first arm, the second arm and the third arm, securing them in a substantially parallel orientation under pressure by the flexible connector.

* * * * *